US011135466B1

(12) United States Patent
Espinosa

(10) Patent No.: US 11,135,466 B1
(45) Date of Patent: Oct. 5, 2021

(54) GRIPLESS WEIGHT LIFTING SYSTEM AND METHOD OF USE

(71) Applicant: Richard Espinosa, Fort Worth, TX (US)

(72) Inventor: Richard Espinosa, Fort Worth, TX (US)

( * ) Notice: Subject to any disclaimer, the term of this patent is extended or adjusted under 35 U.S.C. 154(b) by 0 days.

(21) Appl. No.: 15/910,552

(22) Filed: Mar. 2, 2018

Related U.S. Application Data

(60) Provisional application No. 62/466,133, filed on Mar. 2, 2017.

(51) Int. Cl.
*A63B 21/072* (2006.01)
*A63B 21/00* (2006.01)

(52) U.S. Cl.
CPC ..... *A63B 21/0722* (2015.10); *A63B 21/4035* (2015.10)

(58) Field of Classification Search
CPC . A63B 21/078; A63B 21/072; A63B 21/0783; A63B 21/4029; A63B 21/062; A63B 21/0728
See application file for complete search history.

(56) References Cited

U.S. PATENT DOCUMENTS 5,009,416 A * 4/1991 Caruthers ..... A61H 3/00 294/25
5,302,165 A * 4/1994 Caruthers ..... A63B 21/0605 482/108
8,066,622 B2 * 11/2011 Kim ..... A63B 21/4029 482/130
9,033,854 B1 * 5/2015 Butkovic ..... A63B 21/4029 482/104
2010/0016125 A1 * 1/2010 Bellandi ..... A63B 6/00 482/4

* cited by examiner

*Primary Examiner* — Nyca T Nguyen
*Assistant Examiner* — Andrew M Kobylarz
(74) *Attorney, Agent, or Firm* — Leavitt Eldredge Law Firm

(57) ABSTRACT

A weight lifting system includes a first weight, having a first cavity extending from a bottom surface of the first weight to an interior of the first weight; the first cavity is configured to receive a first hand of a user; and the first cavity positions the first hand in an open position, thereby forcing the user to press the first weight without forming a grip.

2 Claims, 5 Drawing Sheets

GRIPLESS WEIGHT LIFTING SYSTEM AND METHOD OF USE

BACKGROUND

1. Field of the Invention

The present invention relates generally to weight lifting systems, and more specifically, to a grip-less weight lifting system for improving control and safety during weight lifting.

2. Description of Related Art

Weight lifting systems are well known in the art and are effective means to exercise. For example, FIG. 1 depicts a conventional weight lifting system 101 having a weight bench 103 connected to a weight rack 105 configured to hold a bar 107 having one or more weights 109*a*, 109*b*. During use, the user (not shown) lies on bench 103 and grasps bar 107 with both hands and proceeds to press bar 107 above their body.

One of the problems commonly associated with system 101 is safety and limited control. For example, users commonly load bar 107 with excessive weight, which can cause the user to drop bar 107 onto themselves. Additionally, the lifting of bar 107 does not require full control and activation of stabilization muscles.

Accordingly, although great strides have been made in the area of weight lifting systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
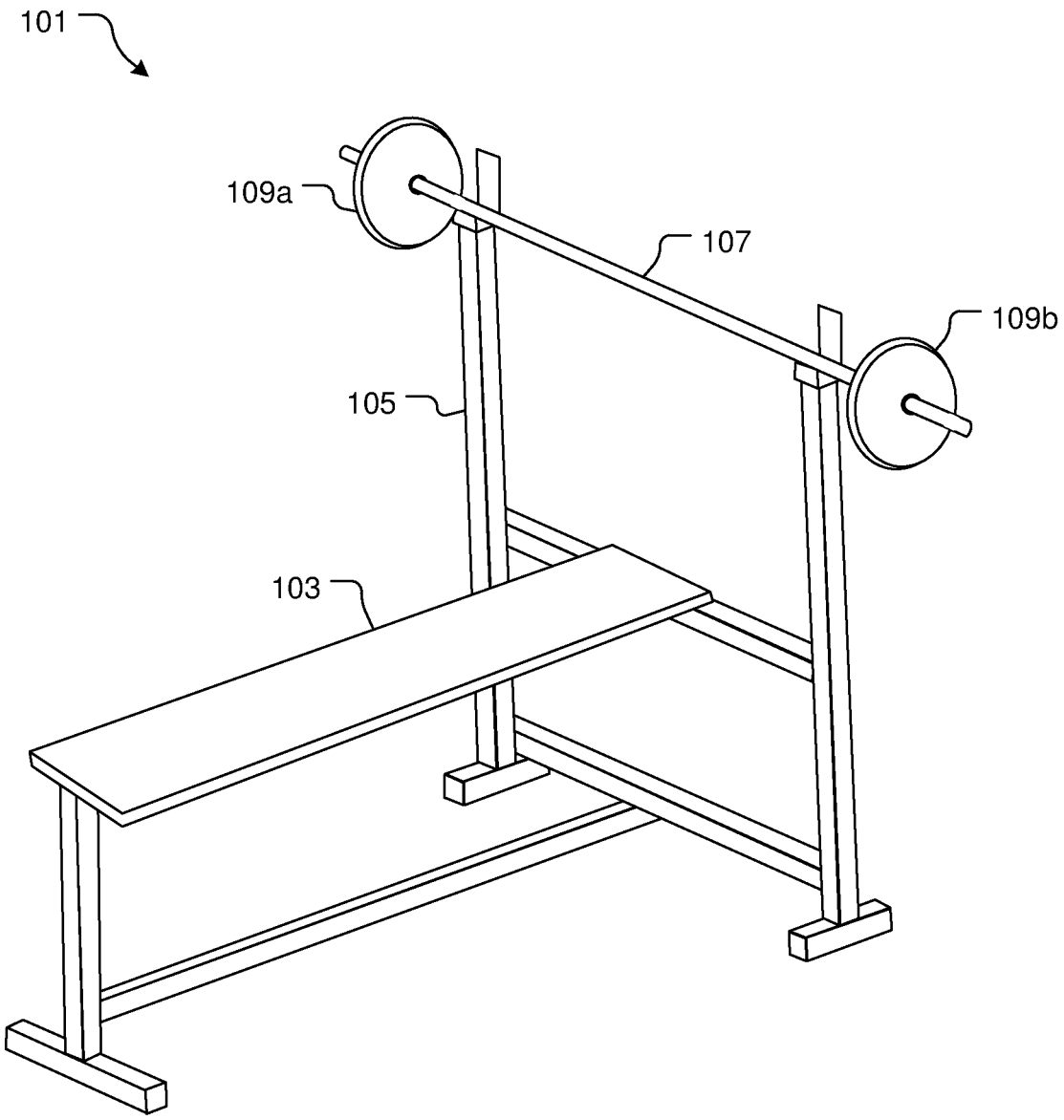
FIG. 1 (Prior Art)
FIG. 1 is an oblique view of a common weight lifting system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional weight lifting systems. Specifically, the present invention provides a means to improve control of stabilization muscles as well as improve safety associated with weight lifting. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
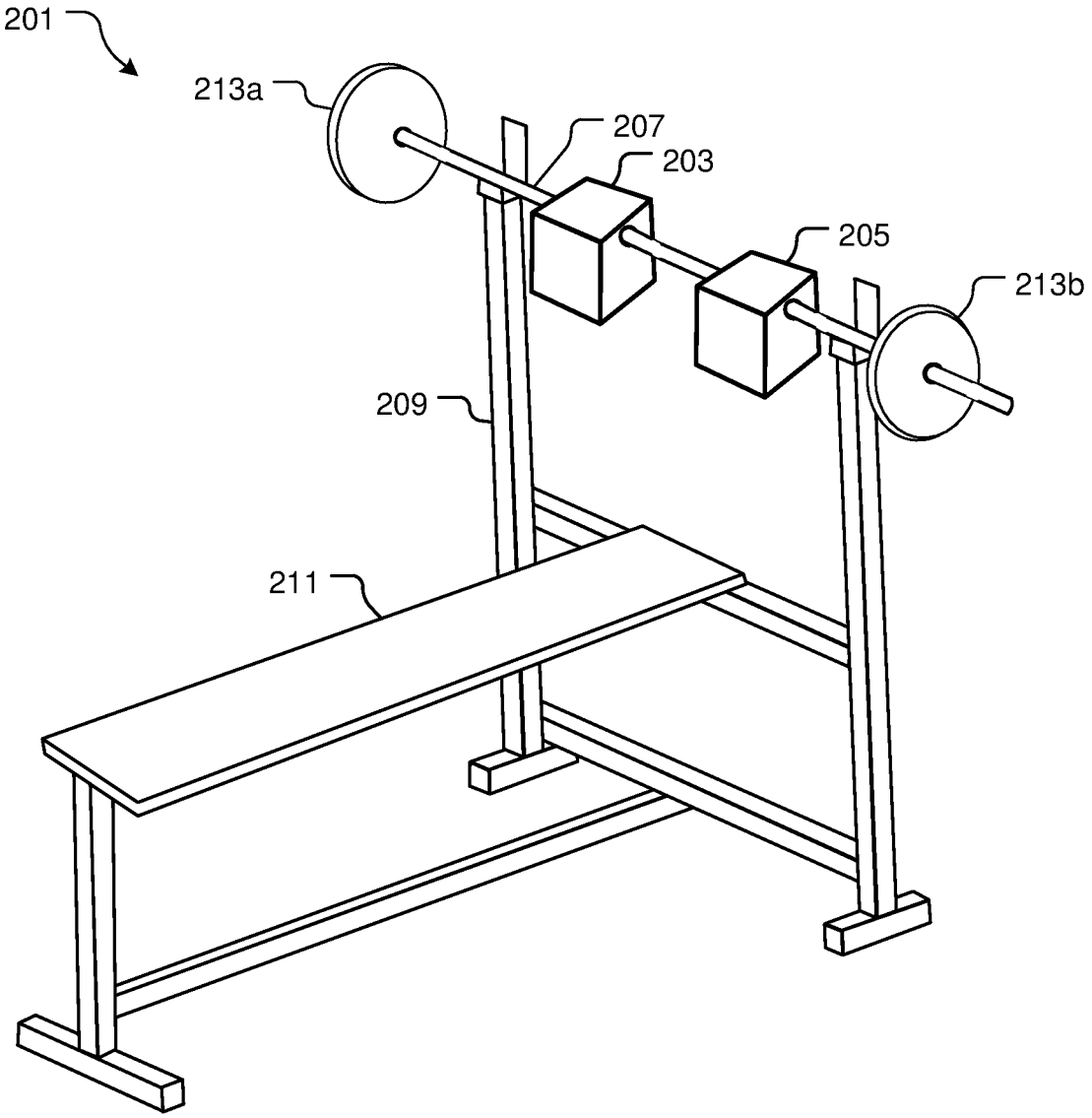
FIG. 2 is an oblique view of a weight lifting system in accordance with a preferred embodiment of the present application.
Figure 3:
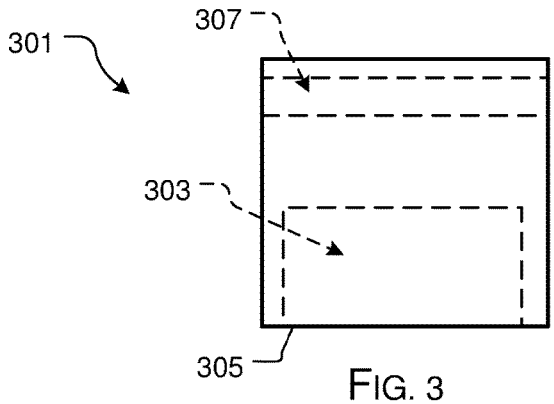
FIG. 3 is a front view of a weight of FIG. 2.

Referring now to the drawings wherein like reference characters identify corresponding or similar elements throughout the several views, FIG. 2 depicts an oblique view of a weight lifting system 201 in accordance with a preferred embodiment of the present application. It will be appreciated that system 201 overcomes one or more of the above-listed problems commonly associated with conventional weight lifting systems.

In the contemplated embodiment, system 201 includes one or more weights 203, 205 secured to a bar 207. It should be appreciated that weights 203, 205 can be removably secured to bar 207, or alternatively incorporated into bar 207. Bar 207 is configured to secure to a weight rack 209 above a bench 211 and receive one or more end weights 213*a*, 213*b*. In this embodiment, weights 203, 205 include interior cavities (not shown) wherein the user places their hands to lift weights without gripping the bar.

In FIGS. 3-6, various views of a grip-less stand alone weight 301 are shown. In the preferred embodiment, weight 301 includes an interior cavity 303 accessible from a bottom surface 305 of weight 301. Cavity 303 is configured to receive a hand of the user, wherein the hand remains substantially flat, thereby creating a grip-less weight lifting system. It is contemplated that weight 301 can be used independently, or alternatively can include a channel 307 disposed through the interior of weight 301, wherein channel 307 is configured to receive a bar.

Figure 4:
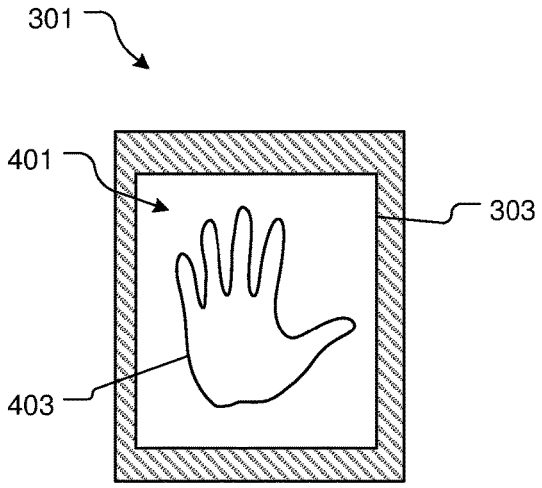
FIG. 4 is a bottom view of the weight of FIG. 2.

In FIG. 4, a bottom view of weight 301 is shown. It is contemplated that cavity 303 can include a substantially flat surface 401 configured to receive a hand in a substantially flat position. In addition, cavity 303 can include a hand imprint 403 configured to receive a user's hand.

Figure 5:
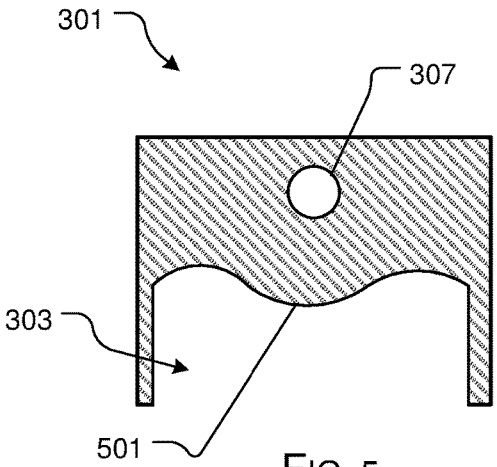
FIG. 5 is a side cross sectional view of an alternative embodiment of a grip-less weight in accordance with the present invention.

In FIG. 5, a side cross sectional view depicts an alternative form of cavity 303, wherein cavity 303 includes a curved surface 501 configured to receive the user's hand in a slightly curved shape. It should be understood that this configuration still prevents the user from forming a grip and forces the user to press against surface 501 with the palm of their hand.

Figure 6:
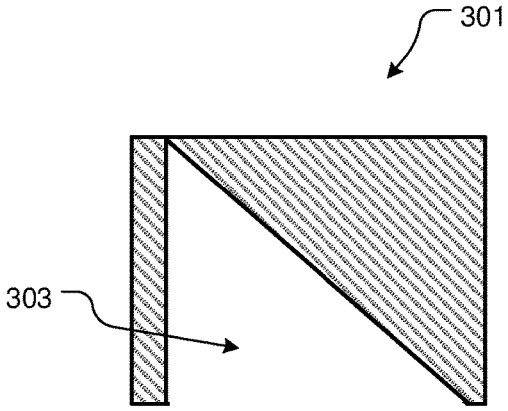
FIG. 6 is a side cross sectional view of an alternative embodiment of a grip-less weight in accordance with the present application.

In FIG. 6 is a side cross sectional view of an alternative form of cavity 303 is shown, wherein cavity 303 includes a triangular shape configured to receive a hand of the user.

It should be appreciated that one of the unique features believed characteristic of the present application is the configuration of cavity 303 allowing for the user to lift weights without the need to grasp a bar. It should be understood that the lack of a grip forces the user to engage stabilization muscles in the arms, thereby improving control and form associated with lifting weights. In addition, the improvement of form can allow the user to lift lighter weight while receiving the same intensity of a workout, thereby improving safety associated with lifting weights.

Figure 7:
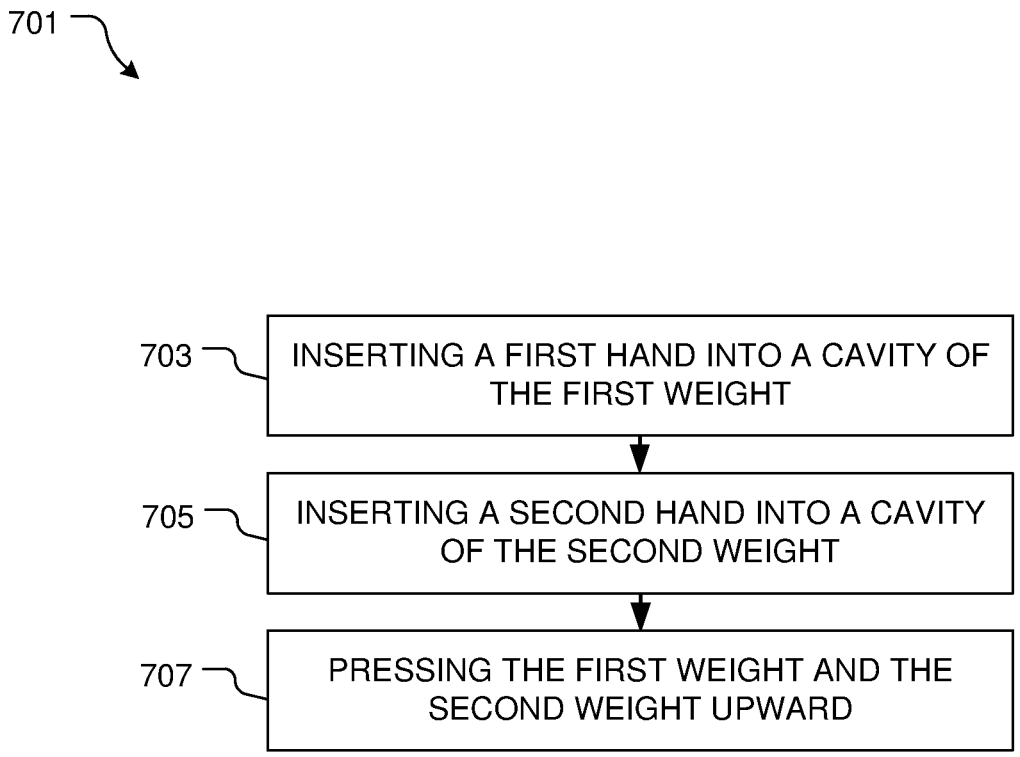
FIG. 7 is a flowchart of the method of FIG. 2.

In FIG. 7, a flowchart 701 depicts a method associated with system 201. It should be understood that the user can lift one or more weights 203, 205 with or without a bar. The user inserts one hand into a cavity of the first weight and the other hand into a cavity of a second weight, as shown with boxes 703, 705. The user can then proceed to raise the weights above their head or chest, depending on the exercise they are performing, as shown with box 707.

Figure 8:
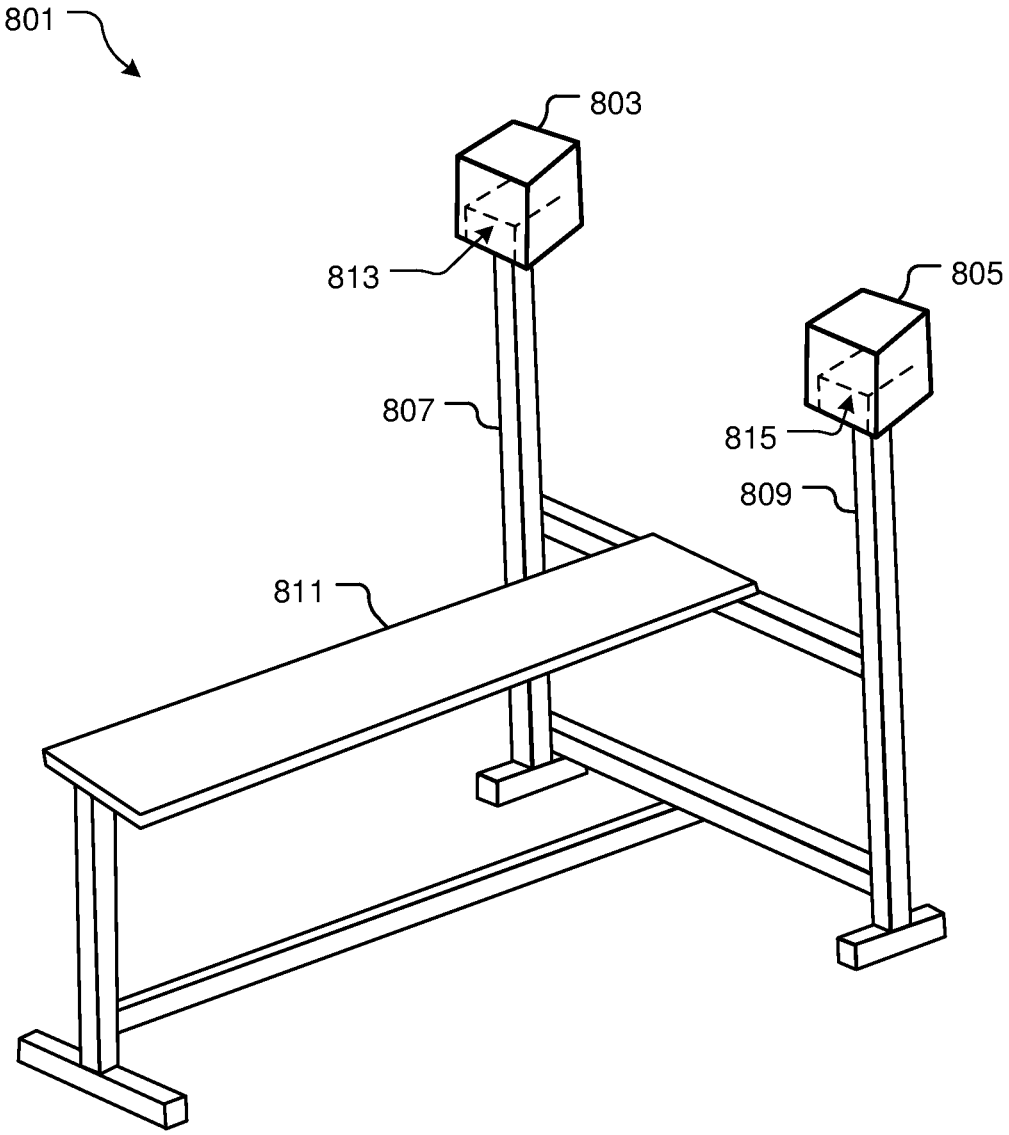
FIG. 8 is an oblique view of an alternative embodiment of a weight lifting system in accordance with a preferred embodiment of the present application.

In FIG. 8, an alternative embodiment of a weight lifting system 801 is shown wherein one or more weights 803, 805, are configured to rest on supports 807, 809 of a weight bench 811. Weights 803, 805 receive supports 807, 809 via cavities 813, 815. It should be appreciated that this embodiment positions gripless weights above a user for lifting from a lying down position.

It should be appreciated that the weights of the present invention can vary in weight, shape, and material while still maintaining the same functionality.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A weight lifting system, comprising:

a bar extending from a first end to a second end, the first end and the second end are configured to removably secure to a plurality of weights;

a first grip-less weight rigidly secured to the bar and disposed between the first end and the second end, having:

a body having a first side surface, an opposing second side surface, and an thickness between the first side surface and the second side surface;

a first housing forming a first cavity extending from a first bottom surface, the first cavity having a first flat surface disposed within the first cavity;

a first flat and open hand imprint imprinted in the first flat surface, the first flat and open hand imprint having a shape to match a first hand of a user;

a channel extending through the thickness from the first side surface to the second side surface, the channel is positioned between an upper surface of the body and the first housing, the channel is configured to receive the bar;

a second grip-less weight rigidly secured to the bar and disposed between the first end and the second end, having:

a second housing forming a second cavity extending from a second bottom surface the second cavity having a second flat surface disposed within the second cavity;

a second flat and open hand imprint imprinted in the second flat surface, the second flat and open hand imprint having a shape to match a second hand of the user.

2. The system of claim 1, further comprising:

a weight rack configured to receive the bar.

* * * * *